US007882668B2

(12) United States Patent
Pedersen

(10) Patent No.: US 7,882,668 B2
(45) Date of Patent: Feb. 8, 2011

(54) WALL SHOE

(76) Inventor: Mark E. Pedersen, 2046 Finch La., San Diego, CA (US) 92113

( * ) Notice: Subject to any disclaimer, the term of this patent is extended or adjusted under 35 U.S.C. 154(b) by 86 days.

(21) Appl. No.: 12/246,380

(22) Filed: Oct. 6, 2008

(65) Prior Publication Data

US 2009/0094933 A1 Apr. 16, 2009

Related U.S. Application Data

(60) Provisional application No. 60/977,767, filed on Oct. 5, 2007.

(51) Int. Cl.
*E04B 1/70* (2006.01)

(52) U.S. Cl. ..... 52/302.3; 52/287.1; 52/169.5; 52/302.1; 52/745.15; 52/481.1; 454/284

(58) Field of Classification Search ..... 52/287.1, 52/288.1, 290, 274, 293.1, 169.5, 302.3, 52/302.4, 481.1, 481.2, 241, 242, 302.1, 52/742.1, 745.15; 454/284
See application file for complete search history.

(56) References Cited

U.S. PATENT DOCUMENTS 1,547,359 A * 7/1925 Butterworth ..... 16/4
2,065,045 A * 12/1936 Broback et al. ..... 428/49
2,717,513 A * 9/1955 Smart ..... 52/264
3,247,895 A * 4/1966 Phillips, Jr ..... 165/50
3,287,866 A * 11/1966 Bevilacqua ..... 52/169.5
4,265,064 A * 5/1981 Parezo ..... 52/302.3
4,265,963 A * 5/1981 Matalon ..... 442/138
5,181,357 A * 1/1993 Pourtau et al. ..... 52/179
5,501,561 A 3/1996 Wulff
5,901,516 A * 5/1999 Watson ..... 52/288.1
6,282,855 B1 9/2001 Shipton
7,421,826 B2 * 9/2008 Collins et al. ..... 52/302.1
2004/0037734 A1 * 2/2004 Toomey ..... 422/1

(Continued)

FOREIGN PATENT DOCUMENTS

DE 3505458 A1 * 8/1986

(Continued)

OTHER PUBLICATIONS http://www.zentyss.ro/pdf/Specificatie_tehnica_EPAN-eng.pdf Feb. 10, 2007.*

*Primary Examiner*—Robert J Canfield
*Assistant Examiner*—Babajide Demuren
(74) *Attorney, Agent, or Firm*—Rader, Fishman & Grauer, PLLC

(57) ABSTRACT

A wall shoe includes a generally rectangular body that is placed beneath a wall covering to protect the wall covering from water damage; the wall shoe providing access to the interior of a wall. A method of extracting moisture from the interior components of a wall includes interposing a wall shoe between a lower edge of a wall covering and a floor, the wall shoe being a rectangular body with a number of channels passing through the thickness of the rectangular body; following exposure of the wall to water, utilizing the wall shoe to provide access to the interior components of the wall; and providing an air flow; the air flow drying the interior of the components of the wall through access provided by the wall shoe.

20 Claims, 5 Drawing Sheets

U.S. PATENT DOCUMENTS

| | | | | |
|---|---|---|---|---|
| 2005/0193659 | A1 | 9/2005 | Peery | |
| 2006/0240725 | A1* | 10/2006 | Dragotta | 442/43 |
| 2007/0125042 | A1* | 6/2007 | Hughes et al. | 52/782.1 |
| 2008/0005986 | A1 | 1/2008 | Thompson | |

FOREIGN PATENT DOCUMENTS

| | | | |
|---|---|---|---|
| JP | 06123170 | A * | 5/1994 |

* cited by examiner

WALL SHOE

BACKGROUND

A variety of situations can arise where it can be desirable to control the humidity levels and water content of materials within a building or other enclosed area need to be controlled. For example, when a building has been flooded or otherwise water damaged, removing water from the materials and air within the building is critical to prevent further damage to the material and reduce the unwanted growth of microorganisms and mold inside the building. If the water is promptly removed from the building by drying out carpets, floors, walls, and other wet items, many of the effects of the unwanted water can be minimized. However, if no efforts are taken to accelerate the drying process, wood framing and drywall may take from several months to several years to dry out, depending on saturation levels. When the conditions are right, mold growth may start in a couple of days, making it important that accelerated drying be started as promptly as possible and remove the water as quickly as possible.

Walls are particularly difficult to dry because they contain enclosed areas that trap moisture, as well as materials that absorb and retain water. For example, the spaces in between studs in a wall create void where water can be trapped. Often the spaces in between the studs are filled with insulation or sound proofing, which absorb and retain water. Many popular wall coverings, such as drywall, absorb and are easily damaged by water.

One method of gaining access to the interior of a wall involves removing the saturated drywall to allow air to circulate through cavities in walls. This destroys the drywall, paint and other decor. Replacing these interior building elements is expensive and time consuming. If the portions of the building interior that contain significant moisture can be rapidly dried, further water damage and mold growth can be avoided. Ideally, this drying would occur without removing the drywall from the building walls.

In many situations, the unwanted water does not fill the entire building, but is only a few inches deep. By protecting and facilitating the access to the bottom portion of the wall, the most frequent damage can be minimized.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

The wall shoe can be placed under the bottom edge of a sheet of drywall such that the drywall is elevated above the floor level. The wall shoe may be installed during construction, restoration, or remodeling. By lifting the drywall a few inches off the floor the wall shoe prevents the drywall and wall coverings from absorbing water in most minor water disasters. Channels through the wall shoe allow the lowest portions of the wall to be quickly dried without removing either the drywall or the wall shoe. In situations where the water damage extends upward and the drywall and wall interior have absorbed significant amounts of water, the wall shoe can be removed to allow access to the interior of the wall. By quickly accessing and drying the interior of the wall, damage to the drywall and interior of the wall can be minimized. In many cases the drywall and interior can be successfully dried before replacement of the wall or drywall is necessary. After the wall has been dried the shoe and baseboard can be replaced or reinstalled, resulting in a significant savings of time and money.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

Figure 1A:
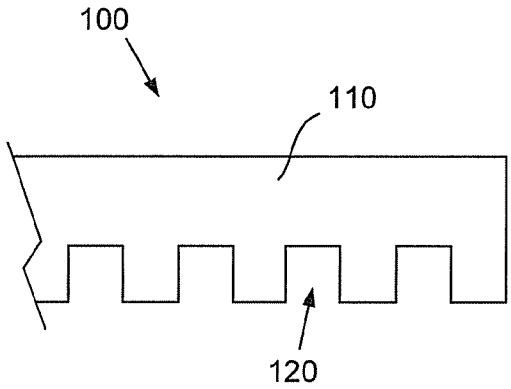
FIGS. 1A, 1B, and 1C are front, side, and perspective view, respectively, of an illustrative wall shoe, according to one embodiment of principles described herein.
Figure 1B:
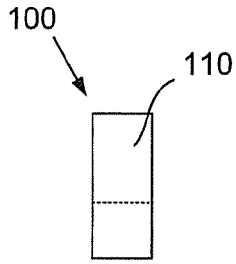
Figure 1C:
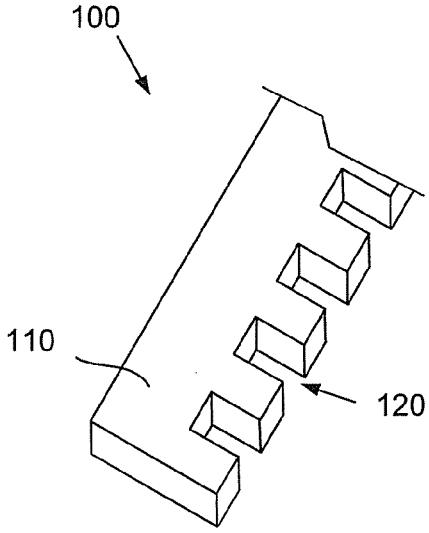

FIGS. 1A, 1B, and 1C illustrate one exemplary embodiment of a wall shoe (100). FIG. 1A shows a front view of a wall shoe (100). The wall shoe is comprised of a generally rectangular body (110). In one exemplary embodiment, the wall shoe (100) has a plurality of channels or grooves (120) through the thickness of the rectangular body (110). In general, the wall shoe (100) can be of any length. In one illustrative embodiment, the wall shoe comes in lengths or rolls that can be cut to the desired size by the installer. In another illustrative embodiment, the wall shoe is substantially the same length as one side of a sheet of drywall. Standard drywall has a short side that is typically four feet wide and a longer side that is typically eight feet high. With the rising popularity of 9 foot ceilings in new home construction, 4.5 feet wide panels have become available. In some commercial applications, drywall sheet which sizes up to 16 feet are used. Additionally, drywall is manufactured in metric sizes, such as a 1.2 meter by 0.9 meter sheet. By manufacturing the wall shoe in sections that correspond to standard drywall dimensions, the wall shoe can be conveniently purchased, transported and installed with the drywall.

The wall shoe (100) may be made of a variety of materials. Suitable materials may be selected for a variety of attributes including water resistance, durability, cost, ease of installation, fire resistance, and other factors. By way of example and not limitation, the wall shoe may be constructed from plastic or other polymer base material, ceramic, stone, wood, composite material, laminate, or other suitable material. According to one exemplary embodiment, the wall shoe (100) is formed from fire proof plastic, such as fireproofed polystyrene.

FIG. 1C shows a perspective view of the wall shoe (100). The channels (120) pass across the thickness of the wall shoe. In one exemplary embodiment, the wall shoe (100) has a thickness that matches the thickness of wall covering that rests above it. By way of example and not limitation, standard drywall can be purchased in thicknesses ranging from ⅜ inch to 1 inch, which ½ and ⅝ths inch thicknesses being most common. According to this embodiment, the wall shoe can be covered by a base board. In another illustrative embodiment, the wall shoe extends beyond the wall covering, creating an integral base board.

The height of the wall shoe (100) may also vary. In one exemplary embodiment, the wall shoe is about 1⅞ inches tall, which will allow the wall shoe to be covered by most common baseboards.

Figure 2:
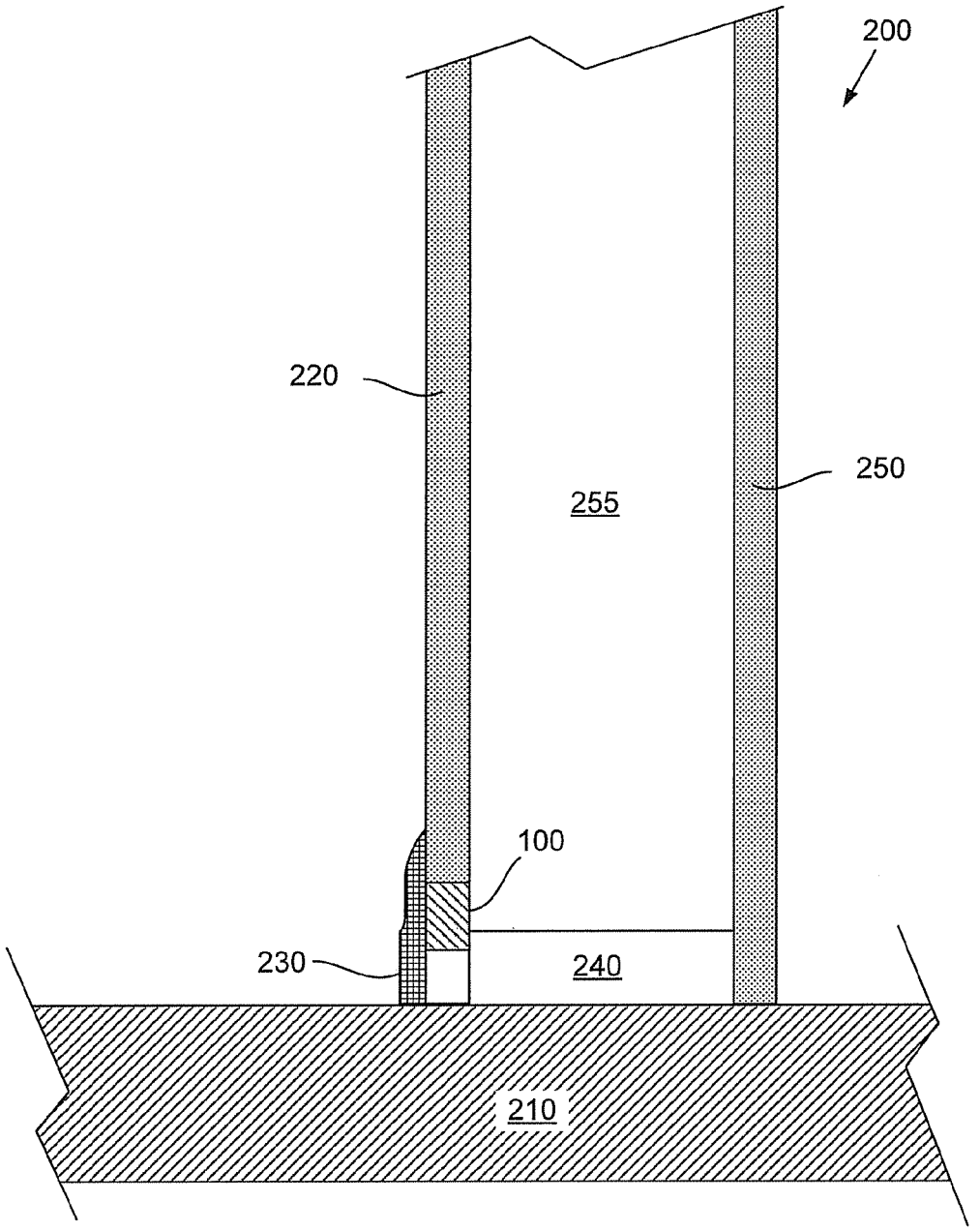
FIG. 2 is a cross-sectional drawing of an illustrative wall shoe installed in a wall, according to one embodiment of principles described herein.

FIG. 2 is a cross-sectional drawing of wall shoe (100) installed in a wall structure (200), according to one exemplary embodiment. As illustrated in FIG. 2, a wall structure (200) is constructed perpendicular to and resting on a floor (210). The sill member (240) is the base structure of the wall (200), and is the most common element to be saturated by floods because of its proximity to the floor (210). The wall shoe (100) is installed along the bottom of the wall (200) so that the channels (120) in the bottom side of the wall shoe are toward the floor and provide access to the through the wall shoe to the sill member (240). The drywall (220) is then place above the wall shoe and secured in position. A base board (230) is then attached to the wall, covering the bottom edge of the drywall (220) and the wall shoe (100). On the opposite side of the wall, a second sheet of drywall (250) is attached to the structural elements of the wall (200), creating an interior cavity (255).

Figure 3:
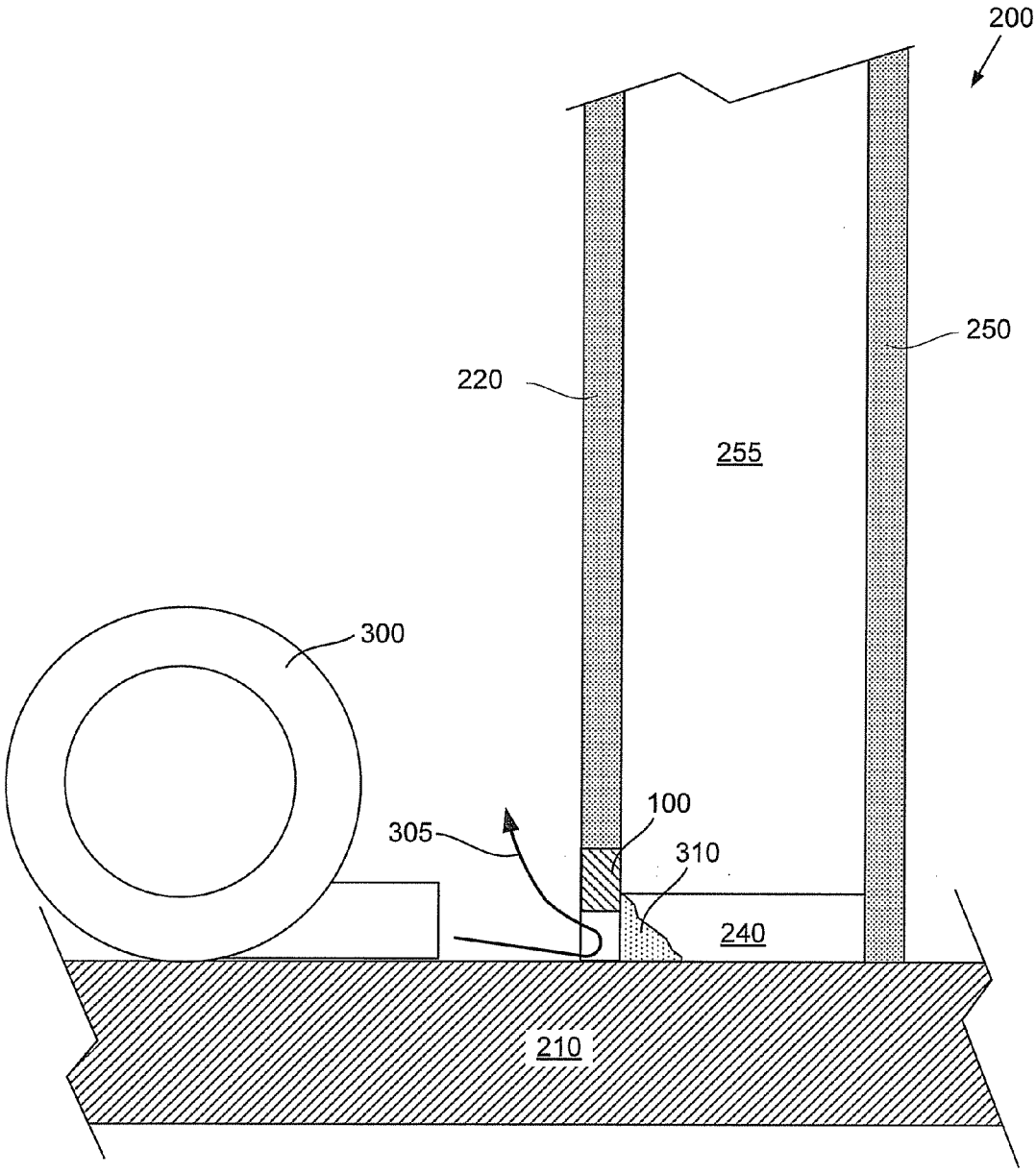
FIG. 3 shows the sill member being dried through channels in an illustrative wall shoe, according to one embodiment of principles described herein.

In the event of a minor flood that does not extend above the wall shoe (100), the wall shoe (100) prevents the drywall (220) from being saturated by water. FIG. 3 shows disaster restoration in progress wherein only a portion of the sill (240) is saturated by water (310). As mentioned above, if this water is not expeditiously extracted, the water can migrate to other areas and contribute to mold growth or other undesirable damage. The baseboard (230, FIG. 2) has been removed and equipment (300) is directing air into the channels (120, FIG. 1) of the wall shoe (100). By way of example and not limitation, the equipment may dehumidify and/or heat the air (305) prior to applying it to water saturated portions of the building. The channels (120, FIG. 1) allow for direct access to the sill. The dehumidified and/or heated air extracts the water (310) from the sill (240) and carries it away. Typically, the moisture laden air is exhausted outside the building to prevent high humidity within the building.

Figure 4:
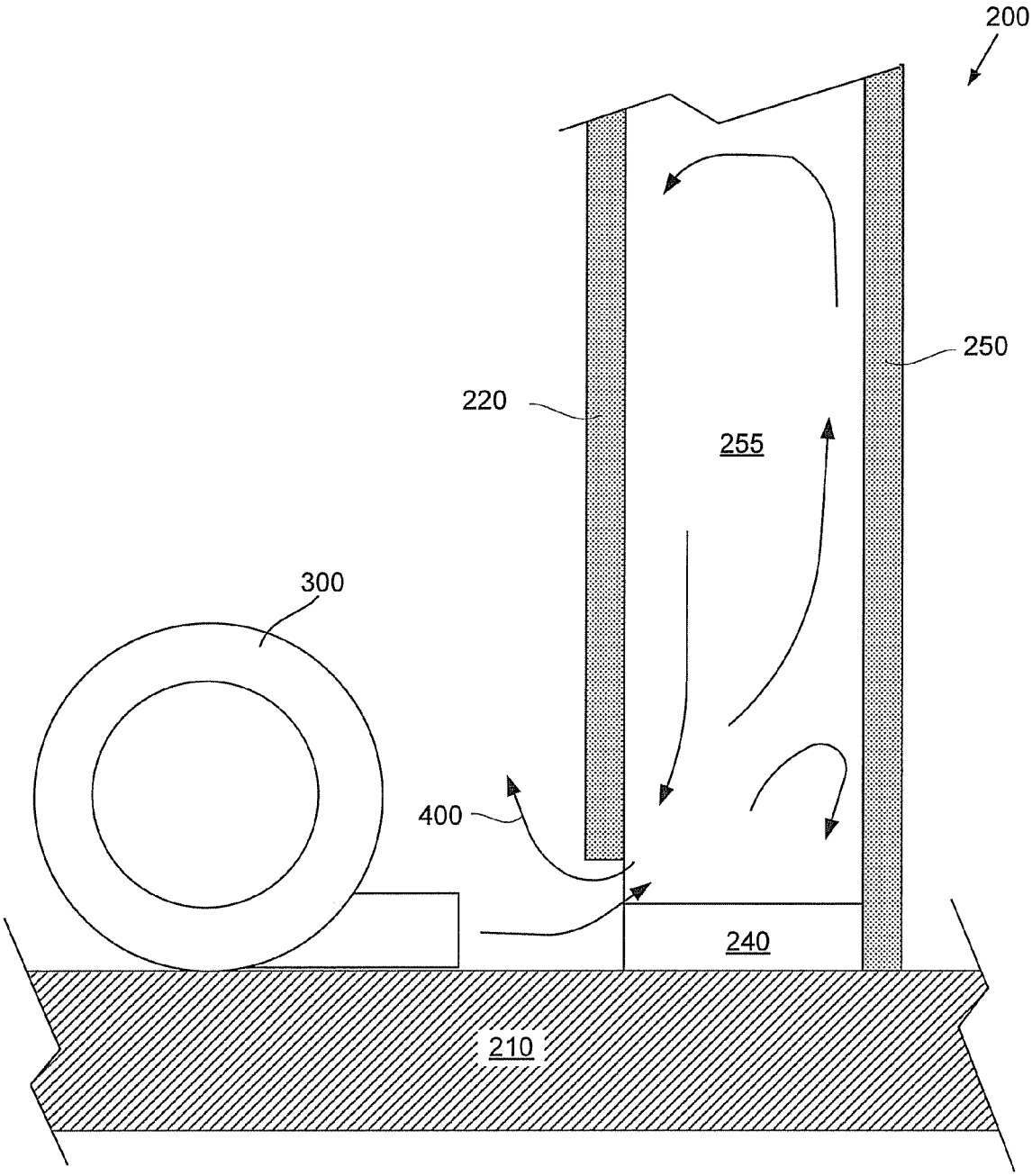
FIG. 4 is an illustrative diagram showing the interior of a wall being dried after the removal of base board and wall shoe, according to one embodiment of principles described herein.

In more severe floods, the wall shoe (100) can facilitate access to the interior areas (255) of the wall. FIG. 4 shows a disaster restoration method where the base board (230, FIG. 2) and wall shoe (100, FIG. 2) have been removed to access the wall interior (255). By removing the baseboard (230) and wall shoe (100, FIG. 2) after a flood or other water damage, the interior of wall (255) can be accessed without the necessity of further damaging the drywall (220). The equipment (300) directs air (400) through the opening created by removing wall shoe (100, FIG. 2). FIG. 4 shows the air (400) entering and exiting through the same opening. In other embodiments, the air may be injected in one location and exit in another location. For example, exiting electrical outlets could be used an additional for entry or exit of air (400). In other embodiments, air may not be actively directed into the cavity. Instead, the air surrounding the saturated materials is heated and/or humidified. The opening in the wall allows for sufficient natural convection and diffusion to dry the interior of the wall. After the wall (200) has been dried, the shoe (100, FIG. 2) and baseboard (230, FIG. 2) can be replaced or reinstalled, resulting in a significant savings of time and money.

Figure 5:
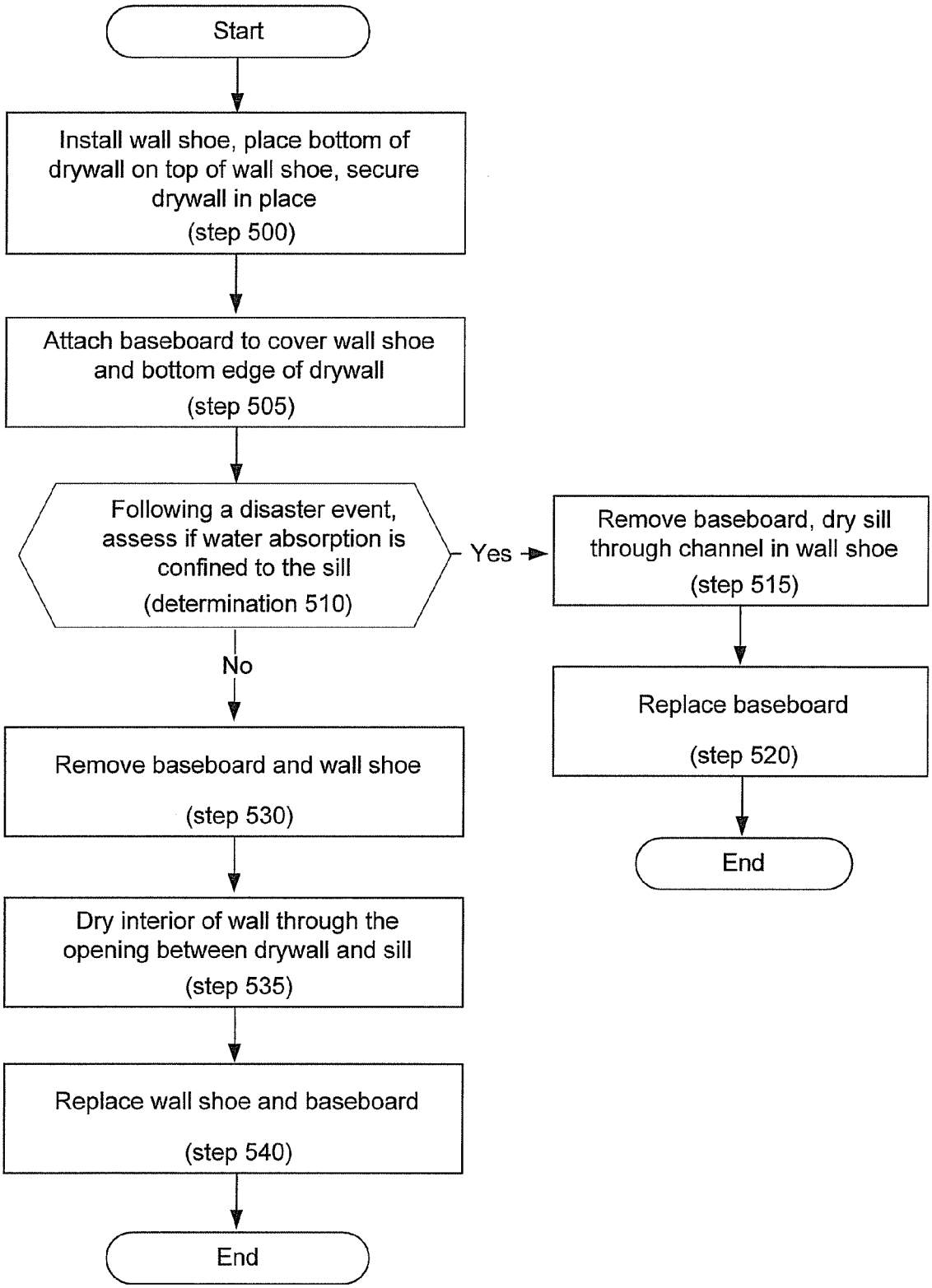
FIG. 5 is a flowchart showing an illustrative method for utilizing a wall shoe to mitigate water damage to walls, according to one embodiment of principles described herein.

FIG. 5 is a flowchart showing an illustrative method for utilizing a wall shoe to mitigate water damage to walls. In a first step, the wall shoe and drywall are installed, with the wall shoe elevating the drywall above the floor (step 500). The baseboard is then attached to cover the wall shoe and bottom edge of the drywall (step 505). Following a disaster event, the water damage is assessed to determine if water absorption is confined to the sill (determination 510). Typically, this would correspond to a water depth of one to one-and-half inches of water. If the water absorption is confided to the sill, the baseboard is removed and the sill is dried through the channels in the wall shoe (step 515). Following the completion of the drying process, the baseboard is replaced (step 520).

If the damage is not confined to the sill, but extends into the interior of the wall, both the baseboard and the wall shoe are removed (step 530) to provide access to the interior of the wall. The interior of the wall is dried through the opening between the drywall and sill (step 535). Following the extraction of the excess moisture from the interior of the wall and wall elements, the wall shoe and base board may be replaced (step 540).

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A wall shoe comprising a generally rectangular body that is placed beneath a wall covering to protect the wall covering from water damage;

wherein said generally rectangular body includes a plurality of channels extending transversely through the thickness of said rectangular body, said channels defined by a first opening on a front face of said rectangular body and a second opening on a rear face of said rectangular body with a passageway extending therebetween;

said wall shoe providing access to the interior of a wall.

2. The wall shoe of claim 1, wherein said plurality of channels provides access for drying air to contact a sill.

3. The wall shoe of claim 1, wherein said wall shoe is constructed from a water proof and fire resistant material.

4. The wall shoe of claim 1, wherein said wall shoe is constructed from fire-resistant polystyrene.

5. The wall shoe of claim 1, wherein said wall shoe has substantially the same thickness as said wall covering.

6. The wall shoe of claim 5, wherein said wall covering is drywall.

7. The wall shoe of claim 6, wherein said wall shoe has a length substantially equivalent to a major dimension of said drywall.

8. The wall shoe of claim 1, wherein said wall shoe is configured to be covered by a baseboard.

9. The wall shoe of claim 1, wherein removal of said wall shoe creates an opening into an interior space of said wall.

10. A method of extracting moisture from the interior components of a wall comprising:

interposing a wall shoe between a lower edge of a wall covering and a floor, said wall covering being attached to a wall;

said wall shoe comprising a generally rectangular body that includes a plurality of channels extending transversely through the thickness of said rectangular body, said channels defined by a first opening on a front face of said rectangular body and a second opening on a rear face of said rectangular body with a passageway extending therebetween;

following exposure of said wall to water, utilizing said wall shoe to provide access to the interior components of said wall;

providing an air flow;

said air flow drying said interior of said components of said wall through access provided by said wall shoe.

11. The method of claim 10, further comprising covering said wall shoe and said lower edge of said wall covering with a baseboard.

12. The method of claim 10, wherein said wall covering is drywall.

13. The method of claim 10, further comprising removing said wall shoe to gain access to said interior of said wall.

14. The method of claim 10, further wherein said channels in said wall shoe provide access for said air flow to dry a sill.

15. The method of claim 10, further comprising replacing said wall shoe and baseboard after said air flow dries said interior components.

16. The method of claim 10, wherein said wall shoe is comprised of fire resistant polystyrene; said wall shoe having a thickness corresponding to the thickness of said wall covering.

17. The method of claim 16, wherein said wall covering is drywall.

18. The method of claim 10, further comprising attaching a baseboard to cover said wall shoe.

19. The wall shoe of claim 1, wherein the channels are spaced apart an equidistance from one another.

20. The wall shoe of claim 1, wherein the channels have a generally square cross section.

* * * * *